US006723181B2

(12) United States Patent
Ishikawa et al.

(10) Patent No.: US 6,723,181 B2
(45) Date of Patent: Apr. 20, 2004

(54) SOFT STAINLESS STEEL SHEET EXCELLENT IN WORKABILITY

(75) Inventors: Hanji Ishikawa, Amagasaki (JP); Masato Otsuka, Amagasaki (JP); Satoshi Suzuki, Shin-Nanyo (JP); Hideki Tanaka, Shin-Nanyo (JP); Junichi Katsuki, Shin-Nanyo (JP); Takashi Yamauchi, Shin-Nanyo (JP); Naoto Hiramatsu, Shin-Nanyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 17 days.

(21) Appl. No.: 10/120,727

(22) Filed: Apr. 11, 2002

(65) Prior Publication Data

US 2003/0102058 A1 Jun. 5, 2003

(30) Foreign Application Priority Data

Apr. 12, 2001 (JP) ..... 2001-113724
Jan. 15, 2002 (JP) ..... 2002-006355

(51) Int. Cl.[7] ..... C22C 38/42
(52) U.S. Cl. ..... 148/325; 148/327
(58) Field of Search ..... 148/325, 327

(56) References Cited

FOREIGN PATENT DOCUMENTS

JP 9263905 7/1997

OTHER PUBLICATIONS

Naoto Ohkubo et al., Effect of Alloying Elements on the Mechanical Properties of the Stable Austenitic Stainless Steel, Jun. 24, 1994, ISIJ International, vol. 24 (1994), No. 9, pp. 764–772.

*Primary Examiner*—Deborah Yee
(74) *Attorney, Agent, or Firm*—Webb Ziesenheim Logsdon Orkin & Hanson, P.C.

(57) ABSTRACT

A new soft stainless steel sheet has an austenite-stability index $Md_{30}$ controlled in a range of −120 to −10 and a stacking fault formability index SFI controlled not less than 30, and involves precipitates whose Cu concentration is controlled not more than 1.0%, so as to maintain concentration of dissolved Cu at 1–5%. The stainless steel sheet preferably contains up to 0.06%(C+N), up to 2.0% Si, up to 5% Mn, 15–20% Cr, 5–9% Ni, 1.0–4.0% Cu, up to 0.003% Al, up to 0.005% S, and optionally one or more of up to 0.5% Ti, up to 0.5% Nb, up to 0.5% Zr, up to 0.5% V, up to 3.0% Mo, up to 0.03% B, up to 0.02% REM (rare earth metals) and up to 0.03% Ca. The stainless steel sheet can be plastically deformed to an objective shape without any cracks even at a part heavily-worked part by multi-stage deep drawing or compression deforming.

$$Md_{30}(^\circ C.)=551-462(C+N)-9.2Si-8.1Mn-29(Ni+Cu)-13.7Cr-18.5Mo$$

$$SFI(mJ/m^2)=2.2Ni+6Cu-1.1Cr-13Si-1.2Mn+32.$$

5 Claims, 3 Drawing Sheets

An Effect Of $Md_{30}$ On Maximum Hardness(HV) Of A Pierced Edge

An Effect Of SFI On Maximum Hardness(HV) Of A Pierced Edge

SOFT STAINLESS STEEL SHEET EXCELLENT IN WORKABILITY

BACKGROUND OF THE INVENTION

The present invention relates to a soft stainless steel sheet, which can be formed to an objective shape with high dimensional accuracy without occurrence of cracking even by severe or multi-stage deep drawing or cold-forging.

Application of a stainless steel excellent in corrosion resistance has been extended to various fields dealing with the deterioration of the environment. For instance, a member of a hydraulic pump, which is usually exposed to a humid atmosphere, is manufactured by shearing a stainless steel sheet 1 to a predetermined size, drawing and punching the sheared sheet 1, piercing the punched sheet 1, stretch flanging forming the pierced sheet 1 so as to expand a pierced part 2 to an expanded edge 3, as shown in FIG. 1.

Austenitic stainless steel such as SUS304 is material much superior in workability to ferritic stainless steel. But, when the austenitic stainless steel is plastically deformed to an objective shape by severe working as shown in FIG. 1, fine cracks often occur especially at the expanded edge 3.

Although the inventors investigated and researched for working conditions which enables formation of an austenitic stainless steel sheet to an objective shape without fine cracks, cracking was not completely suppressed by mere control of working conditions. Then, the inventors investigated effects of materials on occurrence of fine cracks, and reached the conclusion that cracking is assumed to be caused by the following mechanism:

When a product manufactured by working an austenitic stainless steel sheet is observed, strain-induced martensite is often detected. Generation of strain-induced martensite is distinct at a heavily deformed part such as an expanded edge 3. Such the strain-induced martensite makes a stainless steel sheet 1 harder.

When such a heavily deformed part is further worked (expanded), a work stress concentrates at boundaries of the strain-induced martensite due to difference in deformation resistance between austenite grains and the strain-induced martensite. Concentration of a work stress causes occurrence of microcracks. Microcracks are developed by distortion introduced during working and observed as fine cracks.

Fine cracks significantly degrades a commercial value of a product, but also causes troubles on the succeeding steps. It is also difficult to install such a defective member in a hydraulic pump. Furthermore, fine cracks acts as starting points of corrosion, so that a life time of a hydraulic pump is shortened.

Fine cracks are also detected in a product which is manufactured by cold-forging a stainless steel sheet to an objective shape. Moreover, demands for improvement on properties of stainless steel including longevity of forging dies is getting stronger and stronger in correspondence with adoption of severe forging conditions.

SUMMARY OF THE INVENTION

The present invention aims at provision of a soft austenitic stainless steel sheet, which is formed to an objective shape without any cracking even by severe or multi-stage deep drawing, cold forging and also has superior corrosion resistance.

A soft austenitic stainless steel sheet newly proposed by the present invention has an austenite-stability index $Md_{30}$, which is defined by the formula (1), adjusted in a range of −120 to −10, a stacking fault formability index SFI, which is defined by the formula (2), adjusted at a value not less than 30 (preferably 35) and Cu concentration of precipitates not more than 1.0 mass % so as to maintain Cu content dissolved in a matrix at 1.0–4.0 mass %.

$$Md_{30}(^\circ C.)=551-462(C+N)-9.2Si-8.1Mn-29(Ni+Cu)-13.7Cr-18.5Mo \quad (1)$$

$$SFI(mJ/m^2)=2.2Ni+6Cu-1.1Cr-13Si-1.2Mn+32 \quad (2)$$

Not less than 70 mass % of nonmetallic inclusions dispersed in a matrix are preferably composed of MnO—$SiO_2$—$Al_2O_3$ containing not less than 15 mass % of $SiO_2$ and not more than 40 mass % of $Al_2O_3$, in order to improve workability. Furthermore, a work-hardening exponent n defined by an inclination of a true stress-true strain curve detected by a tensile test and elongation El detected by a uniaxial tensile test are preferably adjusted to 0.40–0.55 and not less than 50%, respectively, in order to manufacture a product without occurrence of any cracking even by multi-stage deep drawing.

For use as a cold-forged product, the steel sheet is improved in cold-forgability by adjusting a true stress not more than 1200 MPa at a true strain of 1.0 in a true stress-true strain curve obtained by a compression test at a strain speed of 0.01/second.

The newly proposed austenitic stainless steel sheet preferably consists of up to 0.06 mass % (C+N), up to 2.0 mass % Si, up to 5 mass % Mn, 15–20 mass % Cr, 5–9 mass % Ni, 1–5 mass % Cu, up to 0.003 mass % Al and the balance being essentially Fe except inevitable impurities. The austenitic stainless steel sheet may further contain at least one of up to 0.5 mass % Ti, up to 0.5 mass % Nb, up to 0.5 mass % Zr, up to 0.5 mass % V, up to 3.0 mass % Mo, up to 0.03 mass % B, up to 0.02 mass % REM (rare earth metals) and up to 0.03 mass % Ca.

DETAILED DESCRIPTION OF THE PREFERRED EMBODIMENTS

The inventors assumed that occurrence of cracking during forming an austenitic stainless steel sheet was caused by generation of strain-induced martensite as well as difference in deformation resistance between austenite grains and the strain-induced martensite. On the basis of such the assumption, the inventors have investigated and examined effects of mechanical properties on generation of strain-induced martensite.

Transformation of an austenitic phase to strain-induced martensite is promoted by deformation of crystal lattice of the austenitic phase due to stress introduced during working and concentration of stress in various precipitates dispersed in the austenitic phase.

Generation of the strain-induced martensite is suppressed by such an alloying design as to maintain an austenite-stability index $Md_{30}$, which is defined by the formula (1), in a range of −120 to −10, preferably −90 to −20. However, neither cracking during working nor hardening is completely inhibited by mere stabilization of an austenitic phase, especially in a process for manufacturing a product with heavy deformation. That is, a remaining austenitic phase is also hardened by introduction of strain during working. The work hardening behavior in this case is influenced by increase of dislocations in the austenitic phase of f.c.c. structure, and a degree of work hardening is determined by occurrence of stacking faults.

Possibility to generate stacking faults can be indicated by a stacking fault formability index SFI defined by above-mentioned formula (2). When the stacking fault formability index SFI is small, occurrence of stacking faults is accelerated even by a little energy, and propagation of dislocations is suppressed by the stacking faults. As a result, dislocations are accumulated in the matrix, and an austenitic stainless steel sheet is work-hardened. The stacking fault formability index SFI is remarkably raised by solution of Cu in the matrix. In this regard, an alloying element Cu is not only an alternative additive replacing Ni to save a steel cost, but also an effective element for improvement of formability and decrease of work-hardening during severe or multi-stage deep drawing or cold-forging.

Figure 2:
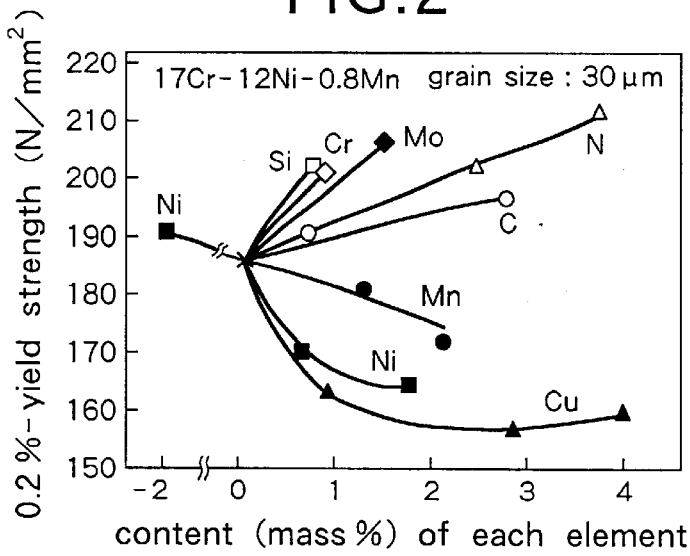
FIG. 2 is a graph showing an effect of each element on yield strength of 17Cr-12Ni-0.8Mn stainless steel.
Figure 3:
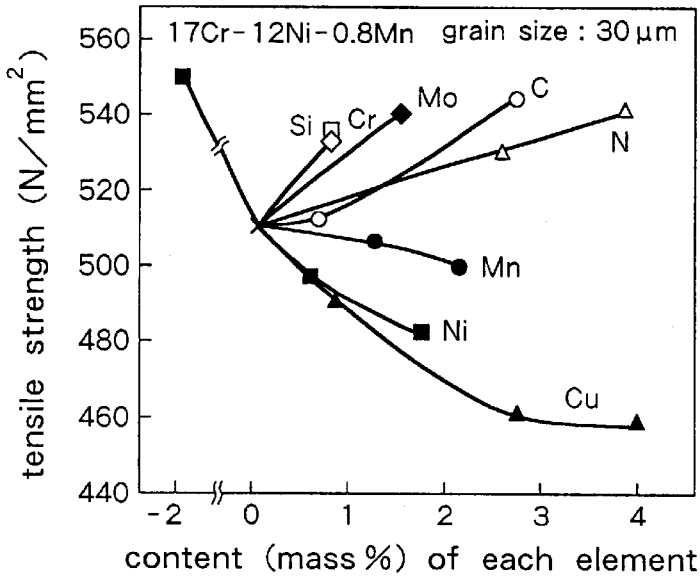
FIG. 3 is a graph showing an effect of each element on tensile strength of 17Cr-12Ni-0.8Mn stainless steel.

The austenite-stability index $Md_{30}$ and the stacking fault formability index SFI are properly adjusted by an alloying design of an austenitic stainless steel. Most important matter is to maintain a ratio of Cu dissolved in a matrix at 1.0–4.0 mass %. Dissolution of Cu at such the ratio remarkably reduces 0.2%-yield strength and tensile strength, as noted in FIGS. 2 and 3, which show effects of each element on yield strength and tensile strength of 17Cr-12Ni-0.8Mn stainless steel, as reported in ISIJ International, Vol. 34 (1994), No.9, p.764–772.

An effect of Cu on softening is bigger than Ni. According to researches of the inventors on the effect of Cu, dissolved Cu exerts a big influence on softening of the stainless steel, but Cu precipitates such as ε-Cu rather degrades workability of the stainless steel. Concentration of Cu in the matrix or the precipitates is detected by EDX-analysis of a sample observed by a transmission electron microscopy (TEM).

Dissolved Cu can be adjusted to a proper ratio by controlling conditions of rolling and heat-treatment during manufacturing a stainless steel strip or sheet. For instance, a proper ratio of dissolved Cu is assured by annealing a hot- or cold-rolled strip at a temperature of 1000° C. or higher. There is not any restriction of a heating time, as far as the strip is heated at 1000° C. or higher.

Generation of strain-induced martensite is suppressed by maintenance of the austenite-stability index $Md_{30}$ in a range of −120 to −10, and occurrence of stacking faults is suppressed by maintenance of the stacking fault formability index SFI at a value not less than 30. Furthermore, hardening caused by generation of the strain-induced martensite and also hardening of an austenitic phase caused by accumulation of dislocations are suppressed by maintenance of dissolved Cu at a ratio of 1.0–4.0 mass %. Consequently, an austenitic stainless steel sheet can be plastically deformed to an objective shape without degradation of workability and softness.

The austenite-stability index $Md_{30}$ not more than −20 assures formation of the austenitic stainless steel to an objective shape under stable working conditions, since the transformation behavior toward strain-induced martensite is hardly influenced by falling of an ambient temperature or rise of a working speed. On the other hand, adjustment of the austenite-stability index $Md_{30}$ not less than −90 favorably saves a steel cost, since austenite formers such as expensive Ni are not necessarily added too much.

The work-hardening exponent n in a range of 0.40–0.55 and elongation El not less than 50% also facilitate a severe or multi-stage deep drawing process for manufacturing a product without cracks. The work-hardening exponent n and the elongation El can be adjusted to proper levels by controlling conditions of rolling and heat-treatment during manufacturing a stainless steel strip.

The work-hardening exponent n is calculated as inclination of a true stress-true strain curve obtained from data of a tensile test using a sample, which is cut off a stainless steel sheet along a transverse direction crossing a rolling direction and shaped to a 13B specimen regulated under JIS Z2201. The elongation El is detected by the same tensile test, wherein a sample is pulled until broken, and the broken pieces are butted together to measure elongation of a distance between marked points.

Furthermore, a stainless steel sheet is plastically deformed with ease during press-working by adjustment of a true stress to a level not more than 1200 MPa at a true strain of 1.0 in a true stress-true strain curve obtained by a compression test at a strain speed of 0.01/second. Such the adjustment is also effective for longevity of metal dies. Consequently, a cold-forged product can be manufactured at an economical cost.

Figure 1:
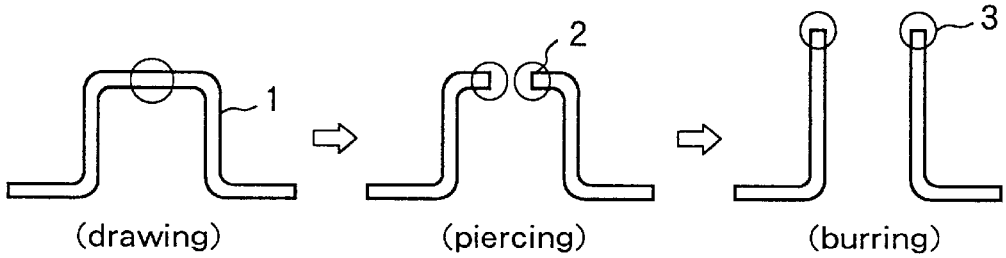
FIG. 1 is a schematic view explaining a process for manufacturing a pump member.

A soft stainless steel sheet, which has a work-hardening exponent n in a range of 0.40–0.55 and elongation El not less than 50%, absorbs a strain introduced during working as plastic deformation (i.e., metal flow). Moreover, softness of austenitic stainless steel itself is maintained during secondary operation due to the alloying design resistant to generation of strain-induced martensite and occurrence of stacking faults. Therefore, the stainless steel sheet can be applied to a member of a hydraulic pump as shown in FIG. 1, but also casing of a motor or sensor manufactured by severe multi-stage deep drawing, and a canopy of a lamp or the like manufactured by ironing.

Workability of the austenitic stainless steel sheet is further improved by conversion of nonmetallic inclusions precipitated in a matrix to soft $MnO—SiO_2—Al_2O_3$. The effect of nonmetallic inclusions on workability is apparently noted by converting not less than 70 mass % of the nonmetallic inclusions to $MnO—SiO_2—Al_2O_3$ containing not less than 15 mass % of $SiO_2$ and not more than 40 mass % of $Al_2O_3$.

$MnO—SiO_2—Al_2O_3$ inclusion is generated by deoxidizing molten steel with a Si alloy containing less than 1 mass % of Al in present of basic slag in a vacuum or non-oxidizing atmosphere. The $MnO—SiO_2—Al_2O_3$ inclusion, different from hard galaxite ($MnO—Al_2O_3$) containing more than 40 mass % of $Al_2O_3$ generated in an ordinary refining process, is elongated in response to plastic deformation of an austenitic stainless steel during working so that it does not act as a point for initiation of cracking.

The newly proposed austenitic stainless steel sheet preferably contains up to 0.06 mass %(C+N), up to 2.0 mass % Si, up to 5 mass % Mn, 15–20 mass % Cr, 5–9 mass % Ni, 1.0–4.0 mass % Cu, up to 0.003 mass % Al and up to 0.005 mass % S. The austenitic stainless steel sheet may further contain at least one or more of up to 0.5 mass % Ti, up to 0.5 mass % Nb, up to 0.5 mass % Zr, up to 0.5 mass % V, up to 3.0 mass % Mo, up to 0.03 mass % B, up to 0.02 mass % REM (rare earth metals) and up to 0.03 mass % Ca.

Although the above-mentioned composition itself is already proposed by the applicant in JP 9-263905 A1, a new austenitic stainless steel sheet good of formability is provided by properly conditioning the austenite-stability index $Md_{30}$ and the stacking fault formability index SFI. The new austenitic stainless steel sheet can be formed to an objective shape without any cracks caused by generation of strain-induced martensite or hardening of an austenite phase, so as to enable of manufacturing a product good of corrosion resistance and dimensional accuracy.

Effects of these alloying elements will be apparent from the following explanation.

(C+N) up to 0.06 Mass %

As increase of C and N contents, an austenitic stainless steel sheet raises its 0.2%-yield strength and hardness due to solution-hardening. C and N unfavorably harden strain-induced martensite, and put harmful influences on deep drawability, stretch flanging formability, secondary operation formability and compression deformability. Excessive addition of C also causes occurrence of fracture (so-called "season-cracking") at a part heavily strained during stretch flanging forming. Defects caused by C and N is inhibited by controlling a total ratio of C and N to 0.06 mass % or less.

Si up to 2.0 Mass %

Si is an alloying element derived from a deoxidizing agent added to molten steel during steel-making. Excessive addition of Si more than 2.0 mass % hardens an austenitic stainless steel sheet, accelerates work-hardening, and degrades secondary operation formability. Si content is preferably controlled not more than 1.2 mass % (more preferably not more than 0.8 mass %), in order to increase a stacking fault formability index SFI to a value of 35 or more effective for suppression of work-hardening.

In the region where Si content exceeds 1.2 mass %, an austenitic stainless steel sheet is improved in stress corrosion cracking-resistance although its workability is somewhat degraded. An alloying design to maintain a stack fault difficulty index SFI at a value not less than 30 is also effective even in such the case, in order to well balance stress corrosion cracking-resistance with secondary operation formability.

Mn up to 5 Mass %

As increase of Mn content, strain-induced martensite is hardly generated, and 0.2%-yield strength, a degree of work-hardening and resistance to compression deformation are reduced. However, excessive addition of Mn more than 5 mass % accelerates damage of refractory during steel-making and generation of Mn-containing inclusions which will act as points for initiation of cracking during working.

15–20 Mass % Cr

Cr is an essential element for improvement of corrosion resistance, and its effect on corrosion resistance is apparently noted at Cr content not less than 15 mass %. Co-presence of Ni intensifies the effect of Cr on corrosion resistance. But, an austenitic stainless steel sheet is made harder, and its secondary operation formability, deep-drawability, stretch flanging formability and compression deformability are unfavorably degraded as increase of Cr content. In this regard, an upper limit of Cr content is determined at 20 mass %.

5–9 Mass % Ni

Ni is an alloying element effective for improvement of corrosion resistance such as pitting resistance in co-presence of Cr. The effect of Ni on corrosion resistance is apparently noted at 5 mass % or more. As increase of Ni content, an austenitic stainless steel is softened and improved in secondary operation formability, deep-drawability, stretch flanging formability or compression deformability due to suppression of work-hardening caused by generation of strain-induced martensite. However, since excessive addition of expensive Ni raises a steel cost, an upper limit of Ni content is determined at 9 mass % accounting the effect on workability in relation with a steel cost.

1.0–4.0 Mass % Cu

Cu is an alloying element, which suppresses work-hardening caused by generation of strain-induced martensite, softens an austenitic stainless steel sheet and improves secondary operation formability, deep-drawability, stretch flanging formability and compression deformability. These effects are typically noted at Cu content not less than 1.0 mass %. Dissolution of Cu in a steel matrix is preferable for realizing such the effects, but workability is rather degraded as increase of Cu-containing precipitates. A ratio of Cu-containing precipitates can be properly suppressed by controlling conditions of rolling and heat-treatment. Since Cu is an austenite former, Ni content can be selected within a broader range as increase of Cu content. For instance, addition of Cu at a ratio of 2.0 mass % or more allows reduction of a lower limit of Ni content near 5 mass %. However, excessive addition of Cu more than 4.0 mass % puts harmful influences on hot-workability of an austenitic stainless steel sheet.

Al up to 0.003 Mass %

Al content shall be controlled to a value not more than 0.003 mass %, in order to convert nonmetallic inclusions, which are precipitated in a steel matrix, to soft and elongatable $MnO—SiO_2—Al_2O_3$. If Al content exceeds 0.003 mass %, hard $Al_2O_3$ clusters, which will act as points for initiation of cracking during working, are easily generated.

S up to 0.005 Mass %

Hot-workability of an austenitic stainless steel sheet in a hot-rolling step is degraded, if S content exceeds 0.005 mass %. S also puts harmful influences on secondary operation formability, deep-drawability, stretch flanging formability and compression deformability. Corrosion resistance is also degraded, since dispersion of MnS inclusion in a steel matrix is accelerated as increase of S content. S content is preferably controlled at a value not more than 0.03 mass %, in order to reduce type-A inclusions, especially MnS, which act as points for initiation of fracture in a working step to expand a pierced part.

0–0.5 Mass % Each of Ti, Nb, Zr and V

Ti, Nb, Zr and V are optional elements, which suppress hardening of an austenitic stainless steel sheet by fixing solution-hardening elements such as C and N, resulting in improvement of secondary operation formability, deep-drawability, stretch flanging formability and compression deformability. The effect of these elements is saturated at 0.5 mass %. A lower limit of each element is preferably determined at 0.01 mass %, in order to convert nonmetallic inclusions to soft $MnO—SiO_2—Al_2O_3$.

0–3.0 Mass % Mo

Mo is also an optional alloying element for improvement of corrosion resistance. But, excessive addition of Mo causes increase of hardness and resistance to compression deformation, so that an upper limit of Mo content shall be determined at 3 mass %.

B is also an optional alloying element for improvement of hot-workability to inhibit cracking during hot-rolling. But, excessive addition of B rather degrades hot-workability, so that an upper limit of B content shall be determined at 0.03 mass %.

0–0.2 Mass % REM (Rare Earth Metals)

REM is also an optional alloying element effective for improvement of hot-workability as the same as B. The effect of REM is saturated at 0.02 mass %, but excessive addition of REM more than 0.02 mass % causes hardening and poor workability of an austenitic stainless steel sheet. An upper limit of REM is preferably 0.005 mass %, in order to convert nonmetallic inclusions to soft $MnO—SiO_2—Al_2O_3$.

0–0.03 Mass % Ca

Ca is also an optional alloying element effective for improvement of hot-workability. The effect of Ca on hot-workability is saturated at 0.03 mass %, and excessive addition of Ca more than 0.03 mass % causes poor cleanliness of an austenitic stainless steel. An upper limit of Ca is preferably 0.005 mass %, in order to convert nonmetallic inclusions to soft $MnO—SiO_2—Al_2O_3$.

EXAMPLE 1

Each stainless steel having composition shown in Table 1 was refined, continuously cast to a slab, and hot-rolled to thickness of 3 mm at an extracting temperature of 1230° C. The hot-rolled steel strip was annealed 1 minute at 1150° C., pickled with an acid, and then cold-rolled to thickness of 0.4 mm. Thereafter, the cold-rolled steel strip was annealed 1 minute at 1050° C., and pickled again.

Each cold-rolled steel strip manufactured in this way had mechanical properties as shown in Table 2.

TABLE 1

COMPOSITIONS OF AUSTENITIC STAINLESS STEELS USED IN EXAMPLE 1

| Steel | Alloying Elements (mass %) | | | | | | | | | | | dissolved Cu | |
|---|---|---|---|---|---|---|---|---|---|---|---|---|---|
| Kind | C | Si | Mn | Ni | Cr | S | Cu | Mo | N | $Md_{30}$ | SFI | (mass %) | NOTE |
| A | 0.014 | 0.37 | 1.69 | 7.91 | 16.90 | 0.001 | 3.20 | 0.10 | 0.021 | −37.8 | 43.2 | 2.9 | Inventive Example |
| B | 0.014 | 0.33 | 1.47 | 12.02 | 17.03 | 0.003 | 1.93 | 0.07 | 0.012 | −114.7 | 45.2 | 1.8 | Inventive Example |
| C | 0.047 | 0.46 | 0.90 | 8.70 | 18.20 | 0.015 | 0.20 | 0.78 | 0.029 | −17.5 | 25.3 | 0.2 | SUS304 |
| D | 0.005 | 0.22 | 1.15 | 9.53 | 18.84 | 0.013 | 0.05 | — | 0.013 | −4.6 | 28.3 | 0.1 | Comparative Example |
| E | 0.020 | 1.44 | 2.03 | 6.99 | 15.90 | 0.004 | 1.95 | — | 0.028 | −22.0 | 20.4 | 1.7 | Comparative Example |

$Md_{30}$ (° C.) = 551 − 462(C + N) − 9.2Si − 8.1Mn − 29(Ni + Cu) − 13.7Cr − 18.5Mo

SFI ($mJ/m^2$) = 2.2Ni + 6Cu − 1.1Cr − 13Si − 1.2Mn + 32

The underlined figures are beyond ranges defined by the present invention

TABLE 2

MECHANICAL PROPERTIES OF STAINLESS STEEL SHEETS

| Steel Kind | 0.2%-yield strength (MPa) | tensile strength (MPa) | Vickers hardness (HV) | elongation* (%) |
|---|---|---|---|---|
| A | 220 | 511 | 111 | 55 |
| B | 222 | 502 | 109 | 52 |
| C | 274 | 637 | 160 | 57 |
| D | 339 | 631 | 154 | 46 |
| E | 288 | 626 | 130 | 55 |

*A value measured by a uniaxial tensile test

Figure 4:
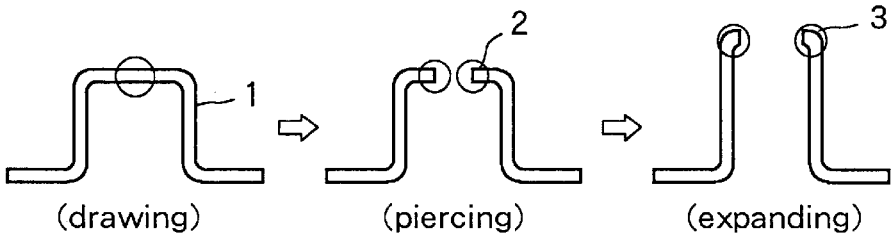
FIG. 4 is a flow chart from drawing to expansion of a pierced part.
Figure 5:
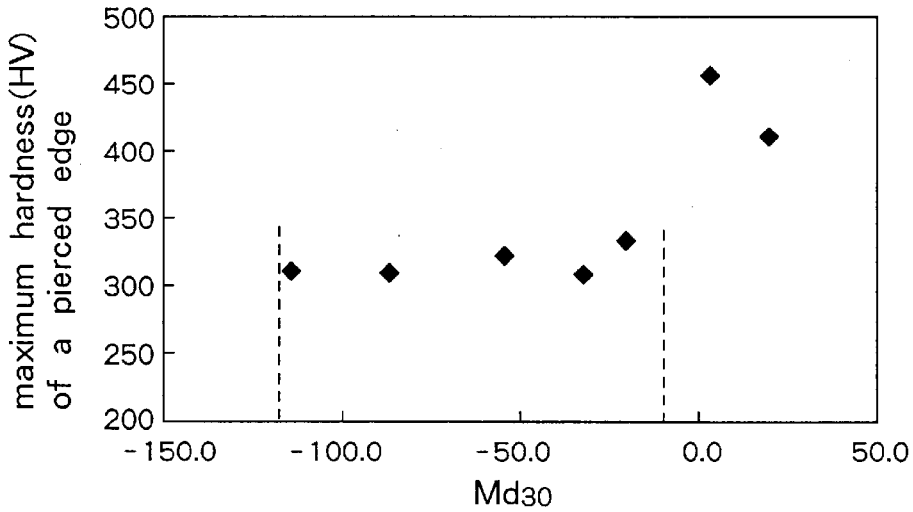
FIG. 5 is a graph showing an effect of an austenite-stability index $Md_{30}$ on maximum hardness of a pierced edge.
Figure 6:
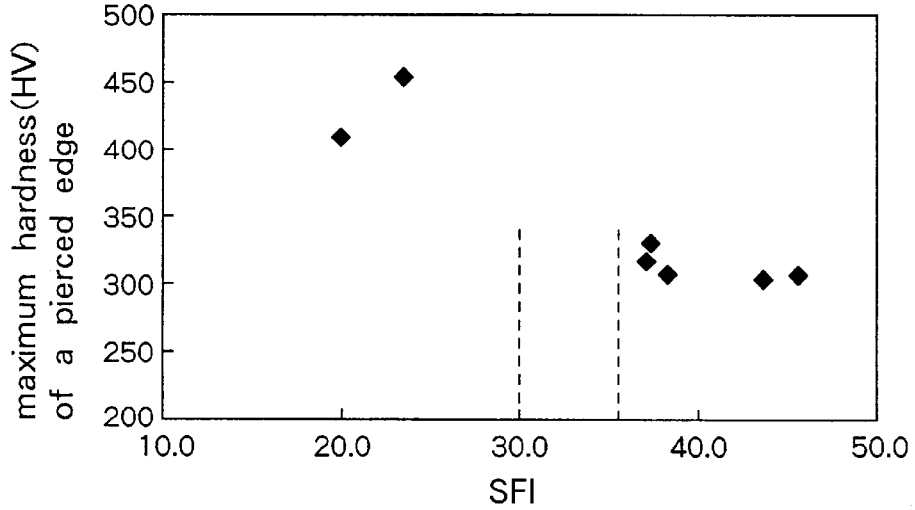
FIG. 6 is a graph showing an effect of a stacking fault formability index SFI on maximum hardness of a pierced edge.
Figure 7:
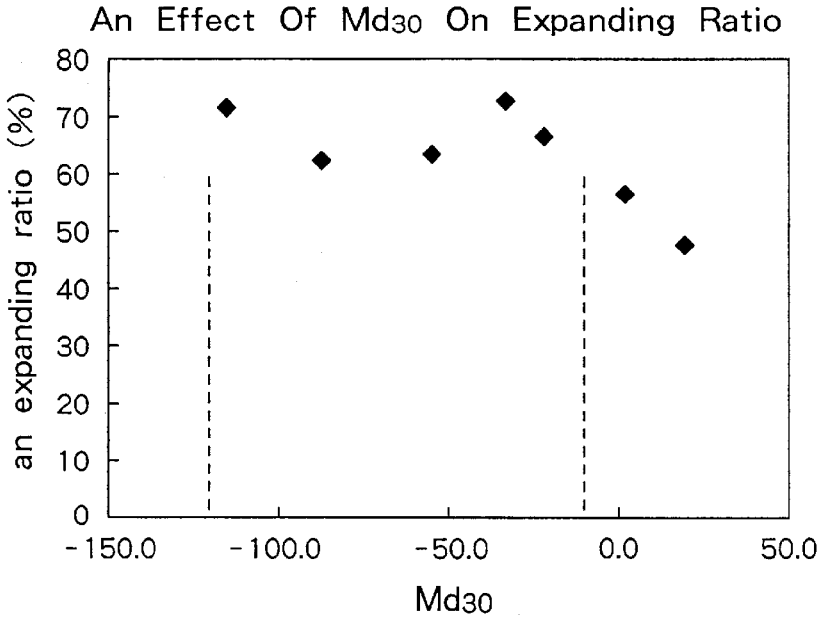
FIG. 7 is a graph showing an effect of an austenite-stability index $Md_{30}$ on a expanding ratio of a pierced edge.
Figure 8:
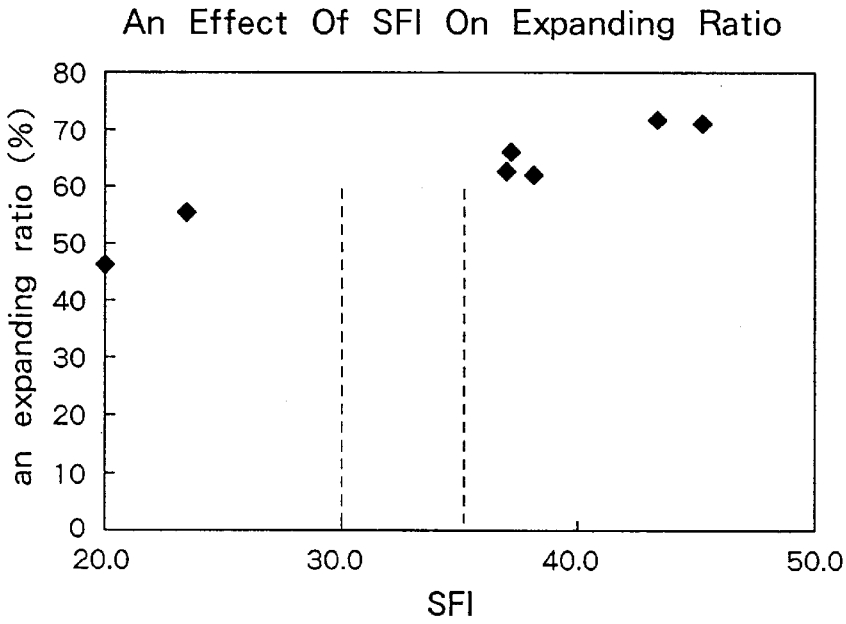
FIG. 8 is a graph showing an effect of a stacking fault formability index SFI on a expanding ratio of a pierced edge.

A blank of 74 mm in diameter was sheared from each stainless steel sheet, and drawn to height of 7 mm with a blank-holding pressure of 1 ton, using a cylindrical punch of 33 mm in diameter having a punch radius of 3 mm and a die of 35 mm in diameter having a die radius of 3 mm. An opening of 10 mm in diameter was then formed in the drawn blank at its center, and then the opened edge 2 was expanded in presence of a lubricating oil having viscosity of 60 $mm^2/s$ (at 40° C.), as shown in FIG. 4, using a cylindrical punch of 33 mm in diameter having a punch radius of 3 mm and a beaded die of 35 mm in diameter having a die radius of 3 mm.

Thereafter, hardness of the pierced edge 2 was measured, and hardening of the blank caused by piercing was evaluated by the maximum value of the measured hardness.

In order to quantitatively evaluate stretch flanging formability, the pierced edge 2 was expanded by pushing a punch therein until occurrence of cracking, a diameter of the opening on occurrence of cracking was measured, and a critical expanding ratio $ER_{cri}$.(%) was calculated according to the formula of: $ER_{cri}=(R_1-R_0)/R_0\times100$, wherein $R_0$ is an initial diameter of the opening and $R_1$ is a diameter of the opening on occurrence of cracking.

Results are shown in Table 3. It is understood that the maximum hardness of the expanded edge 2 was merely 310 HV as for the steel A or 308 HV as for the steel B (Inventive Examples), while the maximum hardness was significantly raised to a value of 360 HV or more as for the steels C to E (Comparative Examples). Cracks were not detected at the expanded edge 2, until an expanding ratio of the edge 2 exceeded 70% as for the steel A or 69% as for the steel B. On the contrary, cracks occurred at the expanded edge 2, even when any of the steels C to E was worked at a fairly low expanding ratio.

TABLE 3

MAXIMUM HARDNESS OF PIERCED EDGES AND CRITICAL EXPANDING RATIOS IN RESPONSE TO STEEL KIND

| Steel Kind | maximum hardness of a pierced edge (HV) | A critical expanding ratio (%) |
|---|---|---|
| A | 310 | 70 |
| B | 308 | 69 |
| C | 362 | 52 |
| D | 381 | 47 |
| E | 390 | 43 |

Results shown in Table 3 prove that the critical expanding ratio is more reduced as a steel sheet was made harder by deep-drawing and piercing. Decrease of the critical expanding ratio means limitation of an opening defined by the expanded edge to small diameter.

Then, the inventors researched and examined an effect of an austenite-stability index $Md_{30}$ on work-hardening as well as an effect of a stacking fault formability index SFI on elongation. For the researches and examinations, various stainless steel sheets were prepared, whose austenite-stability index $Md_{30}$ and stacking fault formability index SFI were varied by increase or decrease of each alloying component on the basis of the composition of the steel A.

A blank sheared from each stainless steel sheet was deeply drawn, pierced and expanded under the same conditions as above-mentioned. Maximum hardness of the expanded edge 2 and a critical expanding ratio were investigated in relation with the austenite-stability index $Md_{30}$ and the stacking fault formability index SFI.

Results are shown in FIGS. 5 to 8. It is understood that a bigger expanding ratio above 60% was gained while suppressing increase of maximum hardness of the expanded edge 2 at a level not more than 350 HV, when the austenite-stability index $Md_{30}$ was controlled in a range of −120 to −10, and the stacking fault formability index SFI was controlled not less than 30.

Accounting these results, a stainless steel sheet (which belongs to the steel A in Table 1) having an austenite-stability index $Md_{30}$ of −37.8 and a stacking fault formability index SFI of 43.2 was drawn to height of 7 mm, pierced with a diameter of 26 mm and burred to expand a pierced edge 2 to diameter of 33 mm under the same conditions as above-mentioned.

1000 pieces of blanks were worked in this way, without occurrence of cracking at the expanded edges 3. Therefore, the blanks were well used as members installed in hydraulic pumps. On the other hand, when blanks sheared from stainless steel sheets having either one or both of an austenite-stability index $Md_{30}$ more than −10 and a stacking fault formability index SFI less than 30 were worked under the same conditions, cracking inevitably occurred at the expanded edge 3.

TABLE 4

EFFECTS OF VALUES $Md_{30}$ AND SFI ON OCCURRENCE OF CRACKING

| | | after piercing | after expanding | | a number of |
|---|---|---|---|---|---|
| $Md_{30}$ | SFI | maximum hardness (HV) of a pieced edge | maximum hardness (HV) of an expanded edge | presence of cracks | defective goods (pieces/1000) |
| −38 | 43 | 310 | 357 | no | 0 |
| −28 | 21 | 361 | 441 | yes | 113 |
| −18 | 20 | 381 | 446 | yes | 204 |
| −2 | 32 | 392 | 453 | yes | 831 |
| −5 | 38 | 390 | 452 | yes | 797 |
| −88 | 42 | 302 | 351 | no | 0 |
| −93 | 29 | 294 | 350 | yes | 76 |
| −42 | 41 | 315 | 363 | no | 0 |
| −37 | 29 | 357 | 438 | yes | 37 |

EXAMPLE 2

Each stainless steel having the composition shown in Table 5 was refined, continuously cast to a slab, hot-rolled to thickness of 3 mm at an extracting temperature of 1230° C. After the hot-rolled steel strip was annealed 1 minute at 1150° C., it was pickled and cold-rolled to thickness of 0.4 mm. Thereafter, the cold-rolled steel strip was finish-annealed 1 minute at 1050° C. and then pickled again.

A blank sheared from each steel strip was observed by a microscope, and $SiO_2$ and $Al_2O_3$ concentrations of nonmetallic inclusions precipitated in a steel matrix were measured by EPMA analysis. Results are shown in Table 6, together with an austenite-stability index $Md_{30}$ and a stacking fault formability index SFI. Cu concentration of precipitates, which was measured by EDX analysis in a visual field of TEM, is also shown in Table 6. On the other hand, Table 7 shows mechanical properties of each stainless steel sheet.

TABLE 5

COMPOSITIONS OF STAINLESS STEELS USED IN EXAMPLE 2

| Steel | Alloying Elements (mass %) | | | | | | | | | |
|---|---|---|---|---|---|---|---|---|---|---|
| No. | C | Si | Mn | Ni | Cr | S | Cu | N | Al | others |
| 1 | 0.010 | 0.32 | 1.58 | 7.96 | 17.01 | 0.001 | 3.19 | 0.010 | 0.0013 | — |
| 2 | 0.020 | 0.60 | 0.56 | 8.91 | 18.21 | 0.003 | 2.12 | 0.020 | 0.0016 | — |
| 3 | 0.030 | 0.45 | 1.44 | 8.20 | 18.45 | 0.002 | 2.86 | 0.028 | 0.0026 | — |
| 4 | 0.040 | 0.44 | 1.44 | 8.31 | 17.81 | 0.001 | 1.95 | 0.022 | 0.0024 | — |
| 5 | 0.052 | 0.29 | 1.21 | 7.31 | 18.46 | 0.001 | 2.03 | 0.040 | 0.0022 | — |
| 6 | 0.012 | 0.95 | 3.12 | 8.20 | 14.60 | 0.002 | 2.85 | 0.010 | 0.0010 | — |
| 7 | 0.020 | 0.50 | 0.51 | 9.12 | 21.51 | 0.002 | 2.21 | 0.020 | 0.0013 | — |
| 8 | 0.010 | 0.41 | 1.31 | 8.19 | 18.43 | 0.006 | 2.01 | 0.010 | 0.0011 | — |
| 9 | 0.020 | 0.55 | 1.12 | 8.74 | 18.31 | 0.008 | 1.99 | 0.011 | 0.0019 | — |
| 10 | 0.020 | 0.44 | 0.65 | 7.42 | 18.33 | 0.001 | 2.23 | 0.020 | 0.0014 | Mo: 2.55 |
| 11 | 0.013 | 0.59 | 0.55 | 7.91 | 16.41 | 0.003 | 1.95 | 0.022 | 0.0008 | Mo: 3.02 |
| 12 | 0.010 | 0.50 | 0.70 | 7.21 | 17.63 | 0.002 | 4.21 | 0.010 | 0.0012 | B: 0.008 |
| 13 | 0.035 | 0.61 | 4.02 | 8.61 | 18.25 | 0.001 | 2.85 | 0.012 | 0.0010 | — |
| 14 | 0.008 | 0.42 | 2.01 | 7.93 | 17.98 | 0.002 | 3.05 | 0.002 | 0.0018 | Ti: 0.002 |
| 15 | 0.011 | 0.83 | 1.12 | 6.32 | 18.93 | 0.001 | 4.33 | 0.008 | 0.0015 | Nb: 0.22 |
| 16 | 0.020 | 0.48 | 0.89 | 8.96 | 18.12 | 0.002 | 1.78 | 0.015 | 0.0017 | Zr: 0.003 |
| 17 | 0.010 | 0.22 | 4.21 | 6.78 | 17.12 | 0.003 | 2.96 | 0.020 | 0.0025 | V: 0.004 |
| 18 | 0.021 | 0.35 | 2.12 | 8.81 | 19.12 | 0.001 | 2.33 | 0.018 | 0.0026 | Ca: 0.001 |
| 19 | 0.018 | 0.65 | 1.58 | 6.92 | 19.52 | 0.001 | 3.35 | 0.011 | 0.0012 | REM: 0.001 |

TABLE 6

$Md_{30}$, SFI AND INCLUSIONS OF EACH STAINLESS STEEL

| Steel | | | nonmetallic inclusions | | |
|---|---|---|---|---|---|
| No. | $Md_{30}$ | SFI | $SiO_2$ concentration (mass %) | $Al_2O_3$ concentration (mass %) | Cu concentration of precipitates (mass %) |
| 1 | −30.4 | 43.9 | 93 | 5 | 0.1 |
| 2 | −46.9 | 35.8 | 77 | 8 | 0.3 |
| 3 | −65.1 | 39.3 | 65 | 21 | 0.1 |
| 4 | −34.9 | 34.9 | 31 | 32 | 0.2 |
| 5 | −27.7 | 34.7 | 45 | 29 | 0.5 |
| 6 | −13.6 | 35.0 | 60 | 5 | 0.1 |
| 7 | −99.5 | 34.6 | 52 | 18 | 0.1 |
| 8 | −20.9 | 34.9 | 17 | 5 | 0.3 |
| 9 | −39.5 | 34.5 | 33 | 21 | 0.1 |

TABLE 6-continued $Md_{30}$, SFI AND INCLUSIONS OF EACH STAINLESS STEEL

| Steel | | | nonmetallic inclusions | | |
|---|---|---|---|---|---|
| No. | $Md_{30}$ | SFI | $SiO_2$ concentration (mass %) | $Al_2O_3$ concentration (mass %) | Cu concentration of precipitates (mass %) |
| 10 | −54.9 | 35.0 | 25 | 13 | 0.1 |
| 11 | −41.7 | 34.7 | 85 | 5 | 0.1 |
| 12 | −41.2 | 46.4 | 96 | 2 | 0.8 |
| 13 | −91.3 | 35.2 | 98 | 1 | 0.3 |
| 14 | −38.5 | 40.1 | 61 | 12 | 0.4 |
| 15 | −42.7 | 38.9 | 74 | 13 | 0.7 |
| 16 | −36.5 | 35.2 | 82 | 14 | 0.2 |
| 17 | −16.0 | 37.9 | 65 | 31 | 0.2 |
| 18 | −72.4 | 37.2 | 42 | 28 | 0.1 |
| 19 | −46.4 | 35.5 | 33 | 11 | 0.2 |

TABLE 7

MECHANICAL PROPERTIES OF EACH STAINLESS STEEL

| Steel No. | 0.2%-yield strength (MPa) | tensile strength (MPa) | Vickers Hardness (HV) | elongation El* (%) | a work-hardening exponent n |
|---|---|---|---|---|---|
| 1 | 195 | 489 | 112 | 64 | 0.40 |
| 2 | 203 | 512 | 123 | 63 | 0.48 |
| 3 | 225 | 530 | 108 | 65 | 0.44 |
| 4 | 264 | 652 | 151 | 61 | 0.52 |
| 5 | 288 | 671 | 158 | 59 | 0.51 |
| 6 | 210 | 514 | 131 | 63 | 0.41 |
| 7 | 291 | 675 | 165 | 61 | 0.43 |
| 8 | 203 | 531 | 118 | 58 | 0.41 |
| 9 | 201 | 525 | 121 | 53 | 0.49 |
| 10 | 281 | 551 | 158 | 56 | 0.51 |
| 11 | 295 | 581 | 171 | 61 | 0.42 |
| 12 | 216 | 498 | 131 | 65 | 0.43 |
| 13 | 222 | 501 | 125 | 66 | 0.40 |
| 14 | 198 | 533 | 121 | 65 | 0.41 |
| 15 | 234 | 541 | 126 | 61 | 0.46 |
| 16 | 241 | 581 | 131 | 68 | 0.44 |

TABLE 7-continued

MECHANICAL PROPERTIES OF EACH STAINLESS STEEL

| Steel No. | 0.2%-yield strength (MPa) | tensile strength (MPa) | Vickers Hardness (HV) | elongation El* (%) | a work-hardening exponent n |
|---|---|---|---|---|---|
| 17 | 218 | 602 | 138 | 62 | 0.42 |
| 18 | 205 | 591 | 118 | 59 | 0.40 |
| 19 | 198 | 570 | 113 | 58 | 0.41 |

*A value measured by a uniaxial tensile test

A blank of 74 mm in diameter was sheared from each stainless steel sheet, and drawn to height of 7 mm with a wrinkle-suppressing pressure of 1 ton, using a cylindrical punch of 33 mm in diameter having a punch radius of 3 mm and a die of 35 mm in diameter having a die radius of 3 mm. The drawn blank was pierced with an opening of 26 mm in diameter at its center bottom, and then burred to expand the pierced part 2 in presence of a lubricating oil having viscosity of 60 $mm^2/s$ (at 40° C.) using a cylindrical punch of 33 mm in diameter with a punch radius of 3 mm and a die of 35 mm in diameter with a die radius of 3 mm, as shown in FIG. 1.

Each blank was observed to research its workability according to occurrence of cracking at the expanded edge 3.

Furthermore, after a 5%-NaCl solution of 35° C. was continuously sprayed 1000 hours to each blank, a surface of each blank was observed by an optical microscope to measure depth of pitting corrosion at 30 points. Pitting resistance was evaluated according to maximum depth of pitting corrosion among the measured values.

Results are shown in Table 8. It is understood that the steels Nos. 1 to 3 are materials suitable for a pump member, which shall be manufactured by a severe multi-stage deep drawing process, since the steels Nos. 1 to 3 were formed to an objective shape without occurrence of cracking and maximum depth of pitting corrosion was suppressed less than 0.1 mm.

On the other hand, a pump member made of the steel No. 4 containing more than 0.06 mass % of (C+N) had the defect that necking occurred at the expanded edge 3, although its pitting resistance was sufficient. A pump member made of the steel No. 5 containing much more of (C+N) involved numerous cracks at the expanded edge 3, and season cracking also occurred at 20 hours after the expansion. The steel No. 5 was poor of pitting resistance, as noted by maximum depth of pitting corrosion above 0.1 mm.

A pump member made of the steel No. 6 containing less than 16 mass % of Cr was good of stretch flanging formability, but poor of pitting resistance as noted by maximum depth of pitting corrosion above 0.1 mm. When the steel No. 7 containing more than 20 mass % of Cr was formed to a pump member, numerous cracks occurred at an edge 3 expanded by stretch flanging forming.

The steel No. 8 containing more than 0.005 mass % of S was good of pitting resistance, but could not be formed to a pump member since necking occurred at an edge 3 expanded by stretch flanging forming. The steel No. 9 could not be formed to a pump member either due to the same defective shaping as the steel No. 8, and its pitting resistance was inferior as noted by maximum depth of pitting corrosion above 0.1 mm.

Any of the other steels Nos. 10 and 12 to 19 containing one or more of Mo V, Al, Ti, Nb, Zr, V, Ca and REM at a ratio defined by the present invention was superior both of stretch flanging formability and pitting resistance, so that it was formed to a pump member without any cracks at the expanded edge 3. However, when a steel No. 11 containing more than 3 mass % of Mo was formed to a pump member, occurrence of cracking was detected at an edge 3 expanded by stretch flanging forming.

TABLE 8

WORKABILITY AND PITTING RESISTANCE OF EACH STEEL

| Steel No. | condition of an expanded edge | maximum depth (mm) of pitting corrosion | integrated evaluation |
|---|---|---|---|
| 1 | good | 0.02 | ○ |
| 2 | good | 0.03 | ○ |
| 3 | good | 0.02 | ○ |
| 4 | necking | 0.07 | X |
| 5 | season cracking | 0.12 | X |
| 6 | good | 0.22 | X |
| 7 | cracking | 0.03 | X |
| 8 | necking | 0.06 | X |
| 9 | necking | 0.15 | X |
| 10 | good | 0.03 | ○ |
| 11 | cracking | 0.04 | X |
| 12 | good | 0.02 | ○ |
| 13 | good | 0.05 | ○ |
| 14 | good | 0.01 | ○ |
| 15 | good | 0.01 | ○ |
| 16 | good | 0.02 | ○ |
| 17 | good | 0.04 | ○ |
| 18 | good | 0.06 | ○ |
| 19 | Good | 0.06 | ○ |

EXAMPLE 3

Each stainless steel having the composition shown in Table 9 was refined, continuously cast to a slab, hot-rolled to thickness of 5 mm at an extracting temperature of 1230° C. After the hot-rolled steel strip was annealed 1 minute at 1100° C., it was pickled.

TABLE 9

COMPOSITIONS OF AUSTENITIC STAINLESS STEELS USED IN EXAMPLE 3

| Steel | Alloying Elements (mass %) | | | | | | | | | | | dissolved Cu |
|---|---|---|---|---|---|---|---|---|---|---|---|---|
| Kind | C | Si | Mn | Ni | Cr | S | Cu | Mo | N | $Md_{30}$ | SFI | (mass %) |
| A | 0.014 | 0.37 | 1.69 | 7.93 | 16.90 | 0.001 | 3.2 | 0.1 | 0.021 | −38.4 | 43.2 | 2.9 |
| B | 0.020 | 1.01 | 1.32 | 7.52 | 17.10 | 0.003 | 2.6 | 0.2 | 0.033 | −24.9 | 30.6 | 1.9 |

TABLE 9-continued

COMPOSITIONS OF AUSTENITIC STAINLESS STEELS USED IN EXAMPLE 3

| Steel | Alloying Elements (mass %) | | | | | | | | | | | dissolved Cu |
|---|---|---|---|---|---|---|---|---|---|---|---|---|
| Kind | C | Si | Mn | Ni | Cr | S | Cu | Mo | N | $Md_{30}$ | SFI | (mass %) |
| C | 0.042 | 0.52 | 0.90 | 8.10 | 18.20 | 0.004 | 0.2 | 0.1 | 0.032 | 12.8 | 23.2 | 0.2 |
| D | 0.005 | 0.61 | 1.82 | 9.12 | 19.11 | 0.008 | 0.1 | 0.2 | 0.013 | −10.6 | 21.5 | 0.1 |
| E | 0.018 | 0.52 | 1.44 | 9.21 | 18.21 | 0.004 | 2.9 | 0.2 | 0.028 | −91.1 | 41.1 | 1.8 |
| F | 0.014 | 0.33 | 1.47 | 8.98 | 18.50 | 0.002 | 4.8 | 0.2 | 0.018 | −135.3 | 54.1 | 3.9 |

$Md_{30}$ (° C.) = 551 − 462(C + N) − 9.2Si − 8.1Mn − 29(Ni + Cu) − 13.7Cr − 18.5Mo
SFI ($mJ/m^2$) = 2.2Ni + 6Cu − 1.1Cr − 13Si − 1.2Mn + 32
The underlined figures are beyond ranges defined by the present invention.

A columnar test piece of 3.0 mm in outer diameter and 4 mm in height was sampled from each stainless steel sheet. The test piece was compressed at a strain speed of 0.01/second along an axial direction of the column, in order to investigate relationship of a true strain with a true stress during compression deformation.

Table 10 shows a value of a true stress with a true strain of 1.0 at the time period when height of each test piece was reduced 60% compared with original height. It is understood that the inventive steels A and B exhibited deformation resistance (represented by the true stress) less than 1200 MPa, while deformation resistance of each comparative steels C to E was fairly bigger than 1200 MPa. A test piece of the comparative steel F was cracked at its side before the true strain reached 1.0, and its deformability was worsened.

TABLE 10

COMPRESSION DEFORMABILITY OF STAINLESS STEEL

| Steel Kind | a true stress (MPa) | evaluation of compression deformability | NOTE |
|---|---|---|---|
| A | 1045 | good | Inventive |
| B | 1035 | good | Examples |
| C | 1456 | bad | Comparative |
| D | 1376 | bad | Examples |
| E | 1429 | bad | |
| F | (undetectable) | bad (cracked before completion of compression) | |

EXAMPLE 4

Each stainless steel having composition shown in Table 9 was refined, continuously cast to a slab, and hot-rolled to thickness of 5 mm at an extracting temperature of 1230° C. Each hot-rolled steel strip was annealed at 1100° C. for 1 minute, pickled and then cold-rolled to thickness of 2 mm. The cold-rolled steel strip was annealed at 1050° C. for 1 minute and then pickled.

Figure 9:
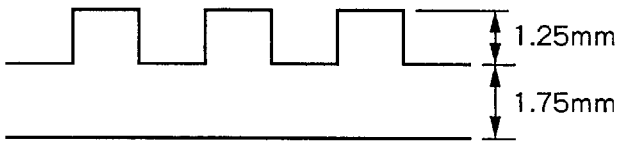
FIG. 9 is a sectional view illustrating a cold-forged product obtained in Example 4.

Many test pieces of 1 m in width and 2 m in length were sampled from each annealed cold-rolled steel strip, and continuously pressed to a shape of cross-section with ruggedness, as shown in FIG. 9. Height of a convex part of the test piece was measured for evaluation of deformability, after the pressing was repeated to 1000 test pieces. Test results are shown in Table 11, together with an austenite-stability index $Md_{30}$, a stacking fault formability index SFI and a ratio of Cu dissolved in a matrix of each stainless steel.

It is understood from Table 11 that a cold-forged product manufactured from the inventive steels A and B, which had austenite-stability indices $Md_{30}$ in a range of −120 to 10, stacking fault formability indices SFI not less than 30 and ratios of dissolved Cu not less than 1.0 mass %, were of 1 mm height or higher at the convex parts, even after the pressing was repeated 1000 times. Such the height was a value of 80% or more compared with predetermined height.

On the other hand, any of cold-forged products made from a comparative steel C having an austenite-stability index above −10 and the stacking fault formability index below 30, the comparative steel D having a stacking fault formability index below 30 and the comparative steel E having the structure that precipitates containing Cu at a ratio above 1.0 mass %, was lower than 1 mm at the convex part after 1000 times pressing. Such lower height was a value less than 80% compared with predetermined height. Decrease of height means significant abrasion of metal dies, and proves short longevity of metal dies. When test pieces sampled from the comparative steel F were pressed, they were not pressed to the objective shape due to occurrence of cracks at the convex part from the beginning of press-working.

TABLE 11

EFFECTS OF $MD_{30}$, SFI AND DISSOLVED CU ON SHAPE OF COLD-FORGED PRODUCTS

| Steel Kind | Austenite Stability Index $Md_{30}$ | Stacking Fault Formability Index SFI | dissolved Cu (mass %) | Shape of cold-forged product after 1000 times pressing: height (mm) at a convex part | a ratio (%) to a predetermined height | judgement |
|---|---|---|---|---|---|---|
| A | −38 | 43 | 2.9 | 1.24 | 99 | ○ |
| B | −25 | 31 | 1.9 | 1.22 | 98 | ○ |
| C | 13 | 23 | 0.2 | 0.76 | 61 | X |
| D | −11 | 22 | 0.1 | 0.83 | 66 | X |

TABLE 11-continued

EFFECTS OF $MD_{30}$, SFI AND DISSOLVED CU ON SHAPE OF COLD-FORGED PRODUCTS

| | Austenite | Stacking Fault | | Shape of cold-forged product after 1000 times pressing | | |
|---|---|---|---|---|---|---|
| Steel Kind | Stability Index $Md_{30}$ | Formability Index SFI | dissolved Cu (mass %) | height (mm) at a convex part | a ratio (%) to a predetermined height | judgement |
| E | −91 | 41 | 1.8 | 0.82 | 66 | X |
| F | −135 | 54 | 3.9 | cracked from the beginning of press-working | | X |

The soft stainless steel sheet newly proposed by the present invention is plastically deformed even at a heavy working ratio without either local accumulation of deformation strains or increase of hardness caused by generation of strain-induced martensite and hardening of an austenitic phase, due to an alloying design to suppress generation of strain-induced martensite and hardening of an austenitic phase, as above-mentioned. As a result, the stainless steel sheet can be formed to an objective shape with sufficient elongation, and defects such as cracks are suppressed even during severe or multi-stage deep drawing. The stainless steel sheet can be also cold-forged to an objective shape with less damage of metal dies, due to decrease of resistance to compression deformation.

What is claimed is:

1. A soft stainless steel sheet excellent in workability and cold-forgability, which has an austenite-stability index $Md_{30}$, which is defined by formula (1), adjusted in a range of −120 to −10, a stacking fault formability index SFI, which is defined by the formula (2), adjusted at a value not less than 30 and Cu concentration of precipitates not more than 1.0 mass % so as to maintain Cu content dissolved in a matrix at 1.0–4.0 mass %, wherein 70 mass % or more of nonmetallic inclusions precipitated in the matrix are MnO—$SiO_2$—$Al_2O_3$ containing not less than 15 mass % of $SiO_2$ and not more than 40 mass % of $Al_2O_3$ $$Md_{30}(^\circ C.)=551-462(C+N)-9.2Si-8.1Mn-29(Ni+Cu)-13.7Cr-18.5Mo \quad (1)$$

$$SFI(mJ/m^2)=2.2Ni+6Cu-1.1Cr-12Si-1.2Mn+32 \quad (2).$$

2. The soft stainless steel sheet defined in claim 1, which consists of up to 0.6 mass %(C+N), up to 2.0 mass % Si, up to 5 mass % Mn, 15–20 mass % Cr, 5–9 mass % Ni, 1.0–4.0 mass % Cu, up to 0.003 mass % Al, up to 0.005 mass % S and the balance being Fe except inevitable impurities.

3. The soft stainless steel sheet defined in claim 2, which further contains at least one of up to 0.5 mass % Ti, up to 0.5 mass % Nb, up to 0.5 mass % Zr, up to 0.5 mass % V. up to 3.0 mass % Mo, up to 0.03 mass % B, up to 0.02 mass % REM (rare earth metals) and up to 0.03 mass % Ca.

4. The soft stainless steel sheet defined in claim 1, which has a work-hardening exponent n, which corresponds to an inclination of a true stress-true strain curve detected by a tensile test, in a range of 0.40–0.55 and elongation El detected by a uniaxial tensile test not less than 50%.

5. The soft stainless steel sheet defined in claim 1, which has a true stress of 1200 MPa or less at a true strain of 1.0 in a true stress-true strain curve obtained by a compression test at a strain speed of 0.01/second.

* * * * *

UNITED STATES PATENT AND TRADEMARK OFFICE

CERTIFICATE OF CORRECTION

PATENT NO. : 6,723,181 B2
APPLICATION NO. : 10/120727
DATED : April 20, 2004
INVENTOR(S) : Ishikawa et al.

It is certified that error appears in the above-identified patent and that said Letters Patent is hereby corrected as shown below:

Column 18, Line 16, Claim 1, formula (2),
"SFI(mJ/$m^2$)=2.2Ni+6Cu-1.1Cr-12Si-1.2Mn+32 .....(2)" should read
-- SFI(mJ/$m^2$)=2.2Ni+6Cu-1.1Cr-13Si-1.2Mn+32 .....(2) --

Column 18, Line 19, Claim 2, "consists of up to 0.6 mass % (C+N)" should read:
-- consists of up to 0.06 mass % (C+N) --

Signed and Sealed this

Nineteenth Day of December, 2006

JON W. DUDAS
*Director of the United States Patent and Trademark Office*